US007772472B2

(12) United States Patent
Chamberlain

(10) Patent No.: US 7,772,472 B2
(45) Date of Patent: Aug. 10, 2010

(54) FIPPLE FLUTE MADE ACTIVE BY A BRASS INSTRUMENT MOUTHPIECE

(75) Inventor: David Paul Chamberlain, 102 Shasta St., Chula Vista, CA (US) 91910

(73) Assignee: David Paul Chamberlain, Chula Vista, CA (US)

( * ) Notice: Subject to any disclaimer, the term of this patent is extended or adjusted under 35 U.S.C. 154(b) by 0 days.

(21) Appl. No.: 12/264,909

(22) Filed: Nov. 5, 2008

(65) Prior Publication Data

US 2010/0107851 A1 May 6, 2010

(51) Int. Cl.
*G10D 9/02* (2006.01)

(52) U.S. Cl. ..... 84/383 R; 84/384

(58) Field of Classification Search ..... 84/380 R, 84/383 R, 384, 385 R, 387, 330, 385 A
See application file for complete search history.

(56) References Cited

U.S. PATENT DOCUMENTS 1,852,749 A * 4/1932 Hiner ..... 84/399
2003/0192421 A1* 10/2003 Ahrens ..... 84/380 R

* cited by examiner

*Primary Examiner*—Kimberly R Lockett

(57) ABSTRACT

In a fipple flute, an instrument body includes an outer surface defining an interior resonating cavity. An airway extends from the outer surface into the resonating cavity and includes an adaptor which joins a brass instrument mouthpiece with a fipple flute. The tone produced from the brass instrument mouthpiece along with the separate tone generated by the fipple whistle allows the player the ability to create new sounds and harmonies.

3 Claims, 1 Drawing Sheet

FIPPLE FLUTE MADE ACTIVE BY A BRASS INSTRUMENT MOUTHPIECE

FIELD OF THE INVENTION

The present invention relates general to musical wind instruments, and is more specifically directed to ocarinas and the airways incorporated therein A new musical wind instrument or an adaptor which joins a brass instrument mouthpiece with a fipple flute. The tone produced from the brass instrument mouthpiece along with the separate tone generated by the fipple whistle allows the player the ability to create new sounds and harmonies

BACKGROUND OF THE INVENTION

Whistle flutes or fipple flutes are a family of wind instruments employing a whistle type mouthpiece, and are among the most ancient of all musical instruments. Among this family are the recorder (also known as a fipple flute or English flute), the flageolet, and the ocarina. The ocarina dates back to antiquity, and is reported to be of South American or Central American descent, though there are indications of its use in other parts of the world.

While it has been generally believed that the qualities of simplicity and limited tonal capacity were inexorably linked in ocarinas, some efforts have been made to improve their musical quality. However, these efforts have been largely unacceptable because they have failed to simultaneously overcome prior art limits on both tonal volume and tonal range.

While popular folk instruments in various circles, the acceptance of prior art ocarinas as concert-quality instruments has been hampered by certain limitations. Two common problems with prior art ocarinas are that they either lack sufficient tonal volume (i.e., loudness), sufficient tonal range (i.e., the number of notes that they can sound), or both. Ocarinas include an airway that directs a musician's airstream across a fipple window to impinge upon a fipple edge, and a series of toneholes disposed on the instrument body penetrating into at least one resonating cavity. An ocarina fipple edge that is a short distance from the point at which air exits the airway (i.e., a short fipple window) will produce a clear focused sound and will play a relatively wide range of notes. However, such an ocarina must be blown relatively softly or the sound will disappear. As a result, the sound emitted from the ocarina will be rather quiet. In addition, the size of the toneholes directly correlates to the size of the tipple window in an accurately tuned ocarina. A short fipple window and its correspondingly small toneholes contribute to a more subdued instrument because small openings do not allow soundwaves to radiate as freely from the instrument's interior into the surrounding air. Conversely, if the fipple edge is moved farther from the point at which air exits the airway (i.e., if the fipple window is made longer), the instrument's loudness will increase because of increased allowable blowing pressure and increased radiation of sound through the larger fipple window and the correspondingly larger toneholes. However, the usual result of a longer fipple window is that the tonal range will either decrease or high notes will be very airy or squeaky. Accordingly, excellent tonal range and excellent tonal volume have rarely been united in prior art ocarinas. Airway/fipple edge design is at the root of the dilemma.

SUMMARY OF THE INVENTION

A new musical wind instrument or an adaptor which joins a brass instrument mouthpiece with a fipple flute. The tone produced from the brass instrument mouthpiece along with the separate tone generated by the fipple whistle allows the player the ability to create new sounds and harmonies A housing which precedes the airway which leads to the fipple whistle of a fipple flute (penny whistle, recorder, slide whistle, flageolet or ocarina) This housing has a tapered female receiver which can hold the shank of a brass wind instrument (trumpet, trombone, French horn, tuba, etc) and seal it to the fipple flute. This housing can be a part of the original fipple flute design or it can be an adaptor for existing fipple flutes. It may have a screw, valve or hole to adjust air pressure and relieve spittle from the housing This housing can be made of fiberglass, polycarbonate, brass, aluminum, ceramic, wood or steel.

BRIEF DESCRIPTION OF THE DRAWINGS

Other objects, features and advantages of the present invention will become apparent from the detailed description of the invention which follows, when considered in light of the accompanying drawings.

DETAILED DESCRIPTION OF THE PREFERRED EMBODIMENTS

Figure 1:
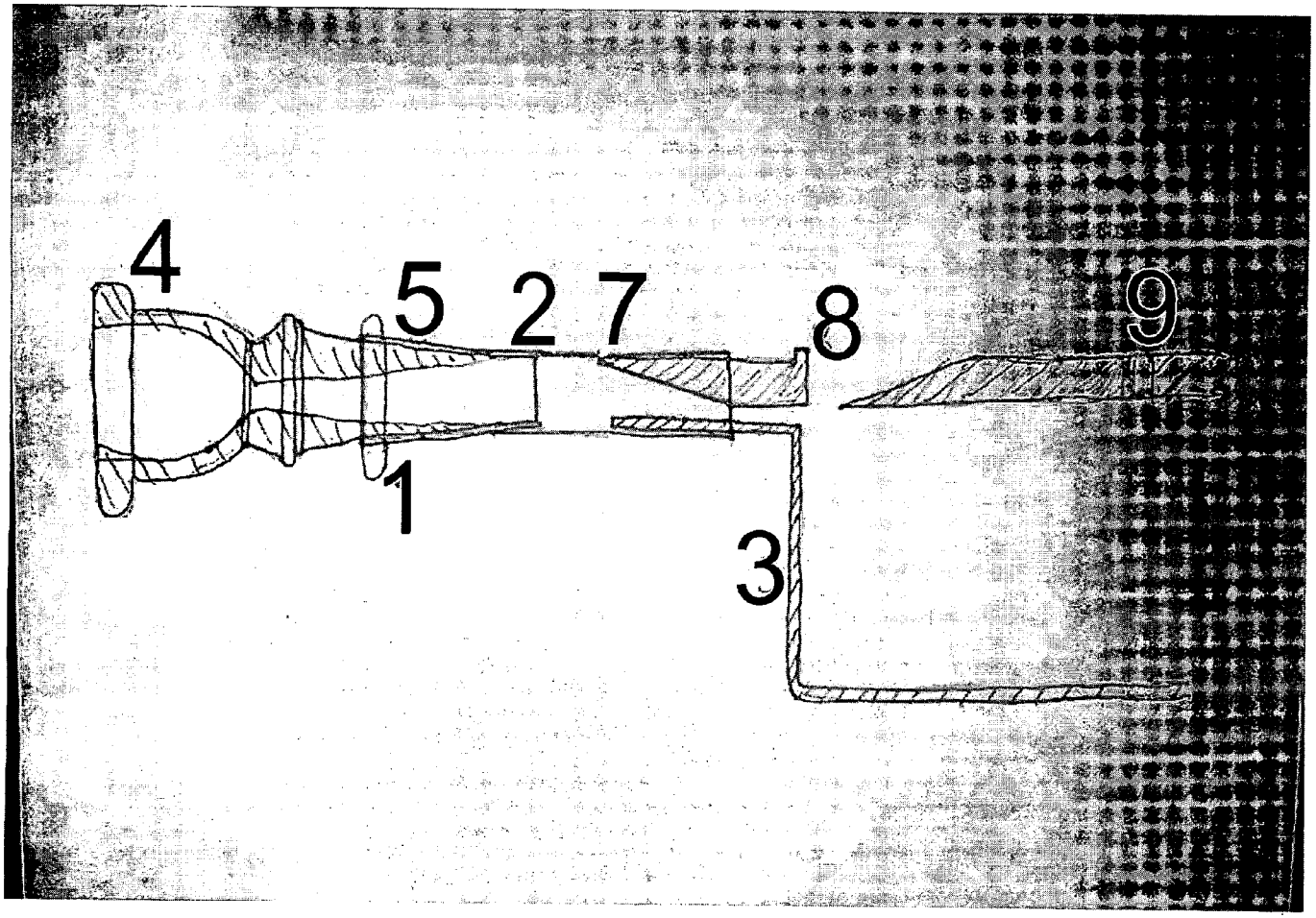
FIG. 1 is a front perspective view of the fipple flute made active by a brass mouthpiece according to the preferred embodiment.

The device has a mouthpiece receiver or adaptor (1) which has a diminishing conical tube (2) and is attached and sealed around a fipple flute wind channel (7). The mouthpiece receiver (1) receives the shank (5) of a trumpet, trombone, French horn, tuba or any other brass mouthpiece (4). The musician buzzes his lips into the mouthpiece (4), thus creating a musical pitch or tone. The musician can create any pitch in the scale depending on how the musician buzzes his lips. The wind (carrying) the musical note, created in the mouthpiece, (4) is compressed in the mouthpiece shank (5) and enters the Fipple flute (7). The wind is directed to the fipple whistle (8), which creates a second musical pitch or tone. The musician can create any pitch in the scale depending on how many of the tone holes (9) are covered or uncovered. These two separate musical tones, one created by the musician's lips or embouchure on the brass mouthpiece (4), and the other musical tone created by the fipple flute gives the musician new and unique musical melodies and harmonies. There are a few ways one may attach a brass mouthpiece (4) to the fipple flute wind channel (7) leading to the resonating body (3). One could simply mold the mouthpiece receiver directly into the fipple flute design. One could also use an adaptor (1) to retrofit an existing fipple flute

What is claimed is:

1. A fipple flute made active by a brass instrument mouthpiece comprising:

a mouthpiece receiver or adaptor which has a diminishing conical tube and is attached and sealed around a fipple flute wind channel of which the mouthpiece receiver receives the shank of a brass instrument mouthpiece.

2. A fipple flute made active by the brass instrument mouthpiece of claim 1 wherein the wind carrying the tone created in the mouthpiece is compressed in the mouthpiece shank and enters the Fipple flute.

3. A fipple flute made active by a brass instrument mouthpiece of claim 1 wherein the wind which is directed to the fipple whistle, creates any pitch in the scale depending on how many of the tone holes are covered or uncovered.

* * * * *